US008960570B2

(12) United States Patent
Drozd et al.

(10) Patent No.: US 8,960,570 B2
(45) Date of Patent: Feb. 24, 2015

(54) TWIST TIP AIR CAP ASSEMBLY INCLUDING AN INTEGRAL SLEEVE FOR A SPRAY GUN

(75) Inventors: Mitchell M. Drozd, Harwood Heights, IL (US); Paul R. Micheli, Glen Ellen, IL (US); Nekheel S. Gajjar, Chicago, IL (US)

(73) Assignee: Finishing Brands Holdings Inc., Minneapolis, MN (US)

( * ) Notice: Subject to any disclaimer, the term of this patent is extended or adjusted under 35 U.S.C. 154(b) by 1155 days.

(21) Appl. No.: 12/908,656

(22) Filed: Oct. 20, 2010

(65) Prior Publication Data

US 2012/0097772 A1 Apr. 26, 2012

(51) Int. Cl.

| | |
|---|---|
| ***B05B 1/28*** | (2006.01) |
| ***B05B 15/04*** | (2006.01) |
| ***B05B 7/12*** | (2006.01) |
| ***B05B 7/08*** | (2006.01) |
| ***B05B 15/02*** | (2006.01) |
| *B05B 3/02* | (2006.01) |
| *B05B 5/025* | (2006.01) |
| *B05B 12/12* | (2006.01) |
| *B05B 12/14* | (2006.01) |
| *B05B 13/04* | (2006.01) |

(52) U.S. Cl.

CPC ..... *B05B 7/12* (2013.01); *B05B 7/0815* (2013.01); *B05B 7/0823* (2013.01); *B05B 15/0275* (2013.01); *B05B 3/02* (2013.01); *B05B 5/025* (2013.01); *B05B 12/122* (2013.01); *B05B 12/1418* (2013.01); *B05B 12/1472* (2013.01); *B05B 13/04* (2013.01)

USPC ..... 239/288.3; 239/119; 239/288; 239/590

(58) Field of Classification Search

CPC .... B05B 15/001; B05B 15/02; B05B 15/0283
USPC ..... 239/119, 288, 288.3, 600, 590
See application file for complete search history.

(56) References Cited

U.S. PATENT DOCUMENTS

| | | | | |
|---|---|---|---|---|
| 4,165,836 | A * | 8/1979 | Eull | 239/119 |
| 4,776,368 | A | 10/1988 | Drozd | |
| 5,280,853 | A * | 1/1994 | Perret, Jr. | 239/119 |
| 5,749,528 | A * | 5/1998 | Carey et al. | 239/119 |
| 5,765,753 | A * | 6/1998 | Kieffer | 239/119 |
| 6,390,386 | B2 * | 5/2002 | Krohn et al. | 239/119 |
| 6,481,640 | B1 * | 11/2002 | Carey et al. | 239/119 |
| 7,028,916 | B2 | 4/2006 | Micheli | |
| 7,311,271 | B2 | 12/2007 | Micheli | |
| 7,568,635 | B2 | 8/2009 | Micheli | |
| 7,762,476 | B2 | 7/2010 | Micheli | |
| 7,789,327 | B2 | 9/2010 | Micheli et al. | |
| 2004/0031860 | A1 | 2/2004 | Micheli | |
| 2004/0046040 | A1 | 3/2004 | Micheli | |

(Continued)

FOREIGN PATENT DOCUMENTS

| | | | |
|---|---|---|---|
| EP | 0215572 | B1 | 12/1986 |
| EP | 215572 | A2 * | 3/1987 |

*Primary Examiner* — Ryan Reis
(74) *Attorney, Agent, or Firm* — Fletcher Yoder P.C.

(57) ABSTRACT

The present technique provides a system and method for improving a tip assembly for a spray coating device. An exemplary spray coating device of the present technique has a twist tip with air-assist channels. The twist tip may be applied to a spray gun and provides a portion of the fluid flow passage of the gun. Rotation of the twist tip alters the fluid flow path, resulting in increased operator control.

14 Claims, 7 Drawing Sheets

(56) References Cited

U.S. PATENT DOCUMENTS

| | | | |
|---|---|---|---|
| 2004/0262416 | A1 | 12/2004 | Micheli |
| 2005/0006498 | A1 | 1/2005 | Micheli |
| 2006/0000928 | A1 | 1/2006 | Micheli |
| 2006/0065760 | A1 | 3/2006 | Micheli |
| 2006/0214027 | A1 | 9/2006 | Micheli |
| 2007/0221762 | A1 | 9/2007 | Micheli et al. |
| 2008/0017734 | A1 | 1/2008 | Micheli et al. |
| 2008/0048055 | A1 | 2/2008 | Micheli |
| 2008/0185009 | A1 | 8/2008 | Choncholas et al. |
| 2008/0295768 | A1 | 12/2008 | Micheli et al. |
| 2008/0296409 | A1 | 12/2008 | Micheli |
| 2009/0148612 | A1 | 6/2009 | Micheli |
| 2009/0230218 | A1 | 9/2009 | Drozd |
| 2009/0277976 | A1 | 11/2009 | Micheli et al. |
| 2009/0302133 | A1 | 12/2009 | Micheli et al. |
| 2010/0006673 | A1 | 1/2010 | Micheli |
| 2010/0050870 | A1 | 3/2010 | Gajjar et al. |
| 2010/0108784 | A1 | 5/2010 | Drozd et al. |

* cited by examiner

TWIST TIP AIR CAP ASSEMBLY INCLUDING AN INTEGRAL SLEEVE FOR A SPRAY GUN

BACKGROUND

The present technique relates generally to spray systems and, more particularly, to industrial spray coating systems. In particular, a system and method is provided for improving spray formation in a spray coating device with an air-assisted spray cap.

BRIEF DESCRIPTION

This section is intended to introduce the reader to various aspects of art that may be related to various aspects of the present system and techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Spray coating devices are used to apply a spray coating to a wide variety of product types and materials, such as wood and metal. An operator may select a particular tip assembly for a spray coating device for forming the desired spray, which may depend on the type of fluid being applied as well as the target object. In particular, for applications in which a fine spray is desired, a tip assembly may include components for shaping the atomized spray into a desired pattern, e.g., a fan shape. However, because such structures provide an additional pathway for the atomized fluid, which generally emerges from an orifice coupled to the spray device, spray-shaping tip assemblies may become clogged or may leak. Accordingly, a technique is needed for a tip assembly that provides a fine spray pattern without clogging to provide more consistent spray formations.

BRIEF DESCRIPTION

The present technique provides a system and method for spray shaping in a spray coating device by providing an air cap tip assembly with improved spray shaping characteristics. The spray gun includes an adjustable air valve that is rotatable about an axis. Valve rotation alters the air pressure and/or air flow, thereby adjusting the shape of the spray pattern. In addition, rotation of the twist tip about the axis reduces clogging of the atomization tip, by pushing out any paint residue that may have been blocking the paint flow inside of the atomization tip. The resulting spray device has improved ability to vary the spray pattern without requiring the operator to change the spray tip. The air cap includes a unique configuration of air-assist air channels about the spray exit point on the air cap to improve the shape characteristics of the exiting spray. In addition controlling the spray pattern shape, the specific configuration of the air flow stream from the air cap, eliminates the paint "tail patterns" associated with smaller twist tip orifice sizes.

DRAWINGS

The foregoing and other advantages and features of the invention will become apparent upon reading the following detailed description and upon reference to the drawings in which.

DETAILED DESCRIPTION

As discussed in detail below, the present technique provides spray tip assembly including an air cap for coating and other spray applications. The spray tip assembly includes a twist tip that is rotatable about an axis such that rotation of the twist tip results in an alteration in the angle or direction of the fluid flow passageway exiting the air cap. The twist tip allows an operator to adjust the fluid flow and the spray pattern and/or spray shape or geometry. Further, the twist tip may be inserted from the top or bottom of the air cap, allowing greater flexibility and control.

In addition, the air cap includes surface features on an integral sleeve that help shape the spray pattern. The surface features include air-assist channels that spray air outwardly from the spray device and interact with the atomized spray at a point forward (e.g., downstream) of the spray gun tip to help form a desired spray pattern. As provided, the air-assist channels are located at least in part in a depression in the surface of the integral sleeve, such that the air ejection ports of the air-assist channels are not level with other portions of the exterior surface of the integral sleeve. That is, the air ejection ports may be angled relative to the fluid ejection passageway. Further, the surface features of the integral sleeve may also include one or more grooves. The relationship between the air-assist channels, the grooves, and the fluid opening bore allow the air-assist features to shape the spray in a desired pattern.

Figure 1:
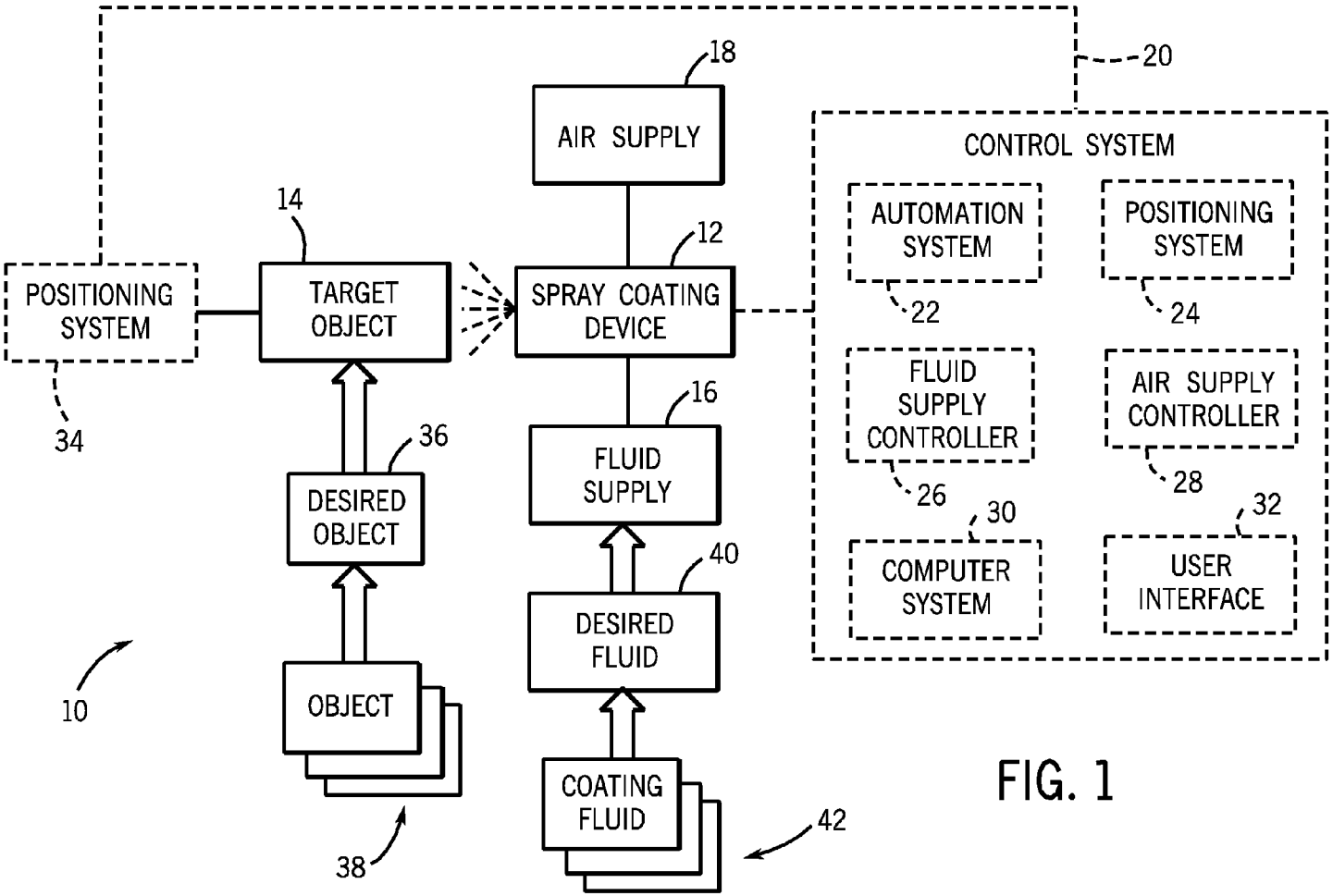
FIG. 1 is a diagram illustrating an exemplary spray coating system of the present technique.

FIG. 1 is a diagram illustrating an exemplary spray coating system 10, which comprises a spray coating device 12 for applying a desired coating to a target object 14. The spray coating device 12 may be coupled to a variety of supply and control systems, such as a fluid supply 16, an air supply 18, and a control system 20. The control system 20 facilitates control of the fluid and air supplies 16 and 18 and ensures that the spray coating device 12 provides an acceptable quality spray coating on the target object 14. For example, the control system 20 may include an automation system 22, a positioning system 24, a fluid supply controller 26, an air supply controller 28, a computer system 30, and a user interface 32. The control system 20 also may be coupled to a positioning system 34, which facilitates movement of the target object 14 relative to the spray coating device 12. Accordingly, the spray coating system 10 may provide a computer-controlled mixture of coating fluid, fluid and air flow rates, and spray pattern. Moreover, the positioning system 34 may include a robotic arm controlled by the control system 20, such that the spray coating device 12 covers the entire surface of the target object 14 in a uniform and efficient manner.

The spray coating system 10 of FIG. 1 is applicable to a wide variety of applications, fluids, target objects, and types/configurations of the spray coating device 12. For example, a user may select a desired fluid 40 from a plurality of different coating fluids 42, which may include different coating types, colors, textures, and characteristics for a variety of materials such as metal and wood. The user also may select a desired object 36 from a variety of different objects 38, such as different material and product types. As discussed in further detail below, the spray coating device 12 also may comprise a variety of different components and spray formation mechanisms to accommodate the target object 14 and fluid supply 16 selected by the user. For example, the spray coating device 12 may be configured to use an air atomizer, a rotary atomizer, an electrostatic atomizer, or any other suitable spray formation mechanism.

Figure 2:
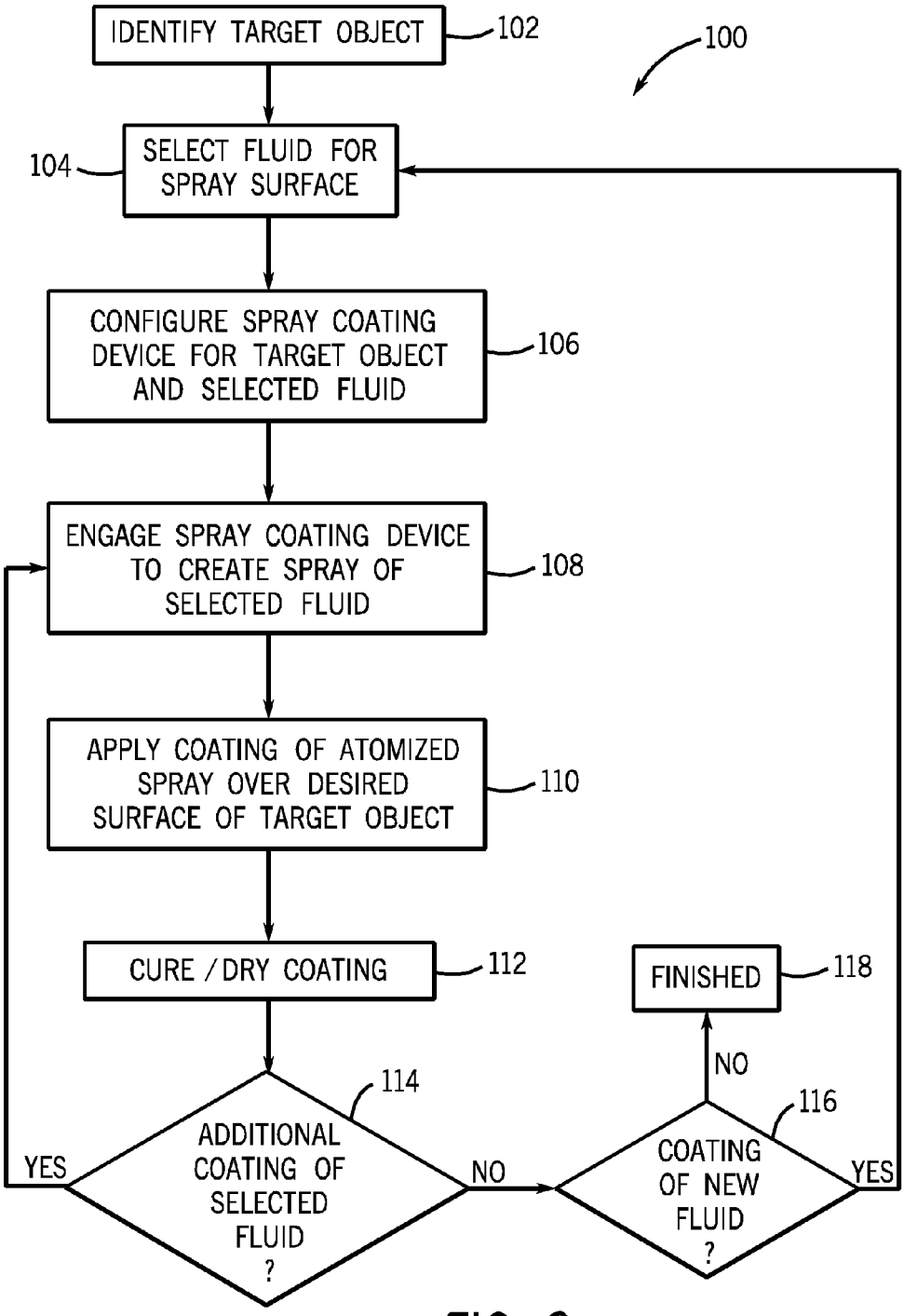
FIG. 2 is a flow chart illustrating an exemplary spray coating process of the present technique.

FIG. 2 is a flow chart of an exemplary spray coating process 100 for applying a desired spray coating to the target object 14. As illustrated, the process 100 proceeds by identifying the target object 14 for application of the desired fluid (block 102). The process 100 then proceeds by selecting the desired fluid 40 for application to a spray surface of the target object 14 (block 104). A user may then proceed to configure the spray coating device 12 for the identified target object 14 and selected fluid 40 (block 106). As the user engages the spray coating device 12, the process 100 then proceeds to create an atomized spray of the selected fluid 40 (block 108). The user may then apply a coating of the atomized spray over the desired surface of the target object 14 (block 110). The process 100 then proceeds to cure/dry the coating applied over the desired surface (block 112). If an additional coating of the selected fluid 40 is desired by the user at query block 114, then the process 100 proceeds through blocks 108, 110, and 112 to provide another coating of the selected fluid 40. If the user does not desire an additional coating of the selected fluid at query block 114, then the process 100 proceeds to query block 116 to determine whether a coating of a new fluid is desired by the user. If the user desires a coating of a new fluid at query block 116, then the process 100 proceeds through blocks 104-114 using a new selected fluid for the spray coating. If the user does not desire a coating of a new fluid at query block 116, then the process 100 is finished at block 118.

Figure 3:
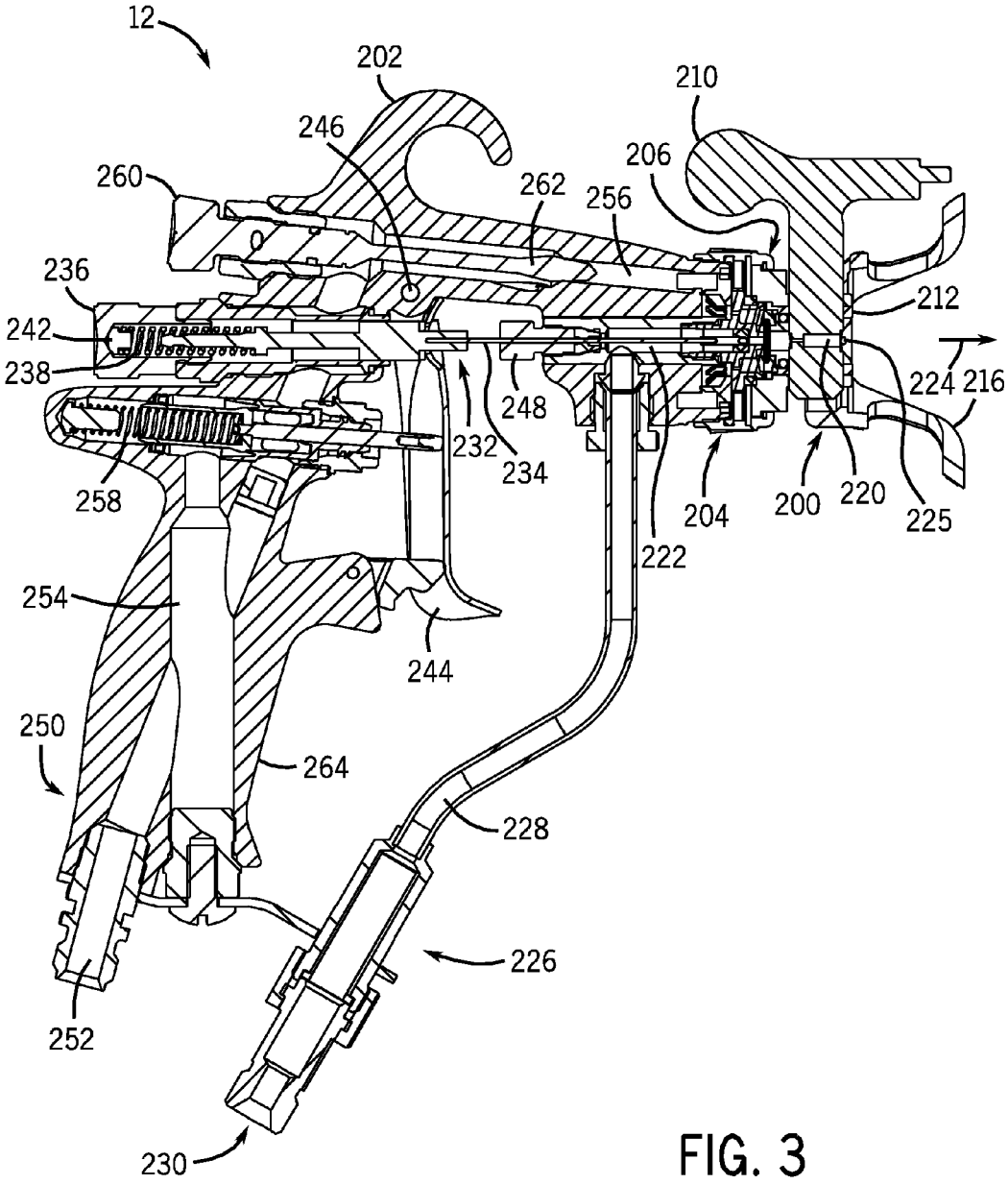
FIG. 3 is a cross-sectional side view of an exemplary spray coating device used in the spray coating system and method of FIGS. 1 and 2.

FIG. 3 is a cross-sectional side view illustrating an exemplary embodiment of the spray coating device 12. As illustrated, the spray coating device 12 comprises a twist tip assembly 200 coupled to a body 202. As discussed in detail below, the twist tip assembly 200 is part of a fluid delivery tip assembly 204 configured to direct the flow of fluid from inside the device 12 and into internal passageways in the twist tip assembly 200 that may atomize the fluid and form a spray having a desired pattern. The twist tip assembly 200 is removably coupled to the body 202, for example via insertion into a receptacle 206 of the body 202. In other embodiments, a plurality of different types of spray coating devices may be configured to receive and use the twist tip assembly 200. It is envisioned that the twist tip assembly 200 may be assembled as a pre-packaged unit that may be coupled to the receptacle 206 of the body 202 via a retaining nut, snap fit, or other suitable locking mechanism. In operation, the twist tip assembly 200 may be applied to the device 12 for use in forming a spray pattern having particular characteristics, e.g., adjustable fan pattern or reduction in overspray. The twist tip assembly 200 may be exchanged for other tip assemblies, depending on the particular application or the target object, or may be replaced and/or repaired as a unit.

The twist tip assembly 200 includes a twist tip 210 that is configured to be inserted into an air cap 212. The twist tip assembly 200 may also include a finger guard 216. In addition, the twist tip assembly 200 may include additional retaining elements that may, at least in part, function to couple the twist tip assembly 200 to the body 202. As discussed in more detail below, the twist tip assembly 200, when applied to the body 202, provides an internal passage 220 (e.g., that includes one or more passages formed by the particular arrangement and alignment of components of the twist tip assembly 200) that directs the flow of fluid from fluid passage 222 downstream, as shown by arrow 224 to an ejection port 225, from which atomized fluid is ejected to form a spray or other suitable pattern. Accordingly, the internal passage 220 of the twist tip assembly 200 aligns with fluid passage 222 when the twist tip assembly 200 is coupled to the body 202.

The body 202 of the spray coating device 12 includes a variety of controls and supply mechanisms for the twist tip assembly 200. As illustrated, the body 202 includes a fluid delivery assembly 226 having a fluid passage 228 extending from a fluid inlet coupling 230 to the fluid delivery tip assembly 204. The fluid delivery assembly 226 also comprises a fluid valve assembly 232 to control fluid flow through the fluid passage 222 and to the fluid delivery tip assembly 204. The illustrated fluid valve assembly 232 has a needle valve 234 extending movably through the body 202 between the fluid delivery tip assembly 204 and a fluid valve adjuster 236. The fluid valve adjuster 236 is rotatably adjustable against a spring 238 disposed the needle valve 234 and an internal portion 242 of the fluid valve adjuster 236. The needle valve 234 is also coupled to a trigger 244, such that the needle valve 234 may be moved inwardly away from the fluid delivery tip assembly 204 as the trigger 244 is rotated counter clockwise about a pivot joint 246. However, any suitable inwardly or outwardly openable valve assembly may be used within the scope of the present technique. The fluid valve assembly 232 also may include a variety of packing and seal assemblies, such as packing assembly 248, disposed between the needle valve 234 and the body 202.

An air supply assembly 250 is also disposed in the body 202 to facilitate atomization at the twist tip assembly 200. The illustrated air supply assembly 250 extends from an air inlet coupling 252. The air supply assembly 250 also includes a variety of seal assemblies, air valve assemblies, and air valve adjusters to maintain and regulate the air pressure and flow through the spray coating device 12. For example, the illustrated air supply assembly 250 includes an air valve assembly 258 coupled to the trigger 244, such that rotation of the trigger 244 about the pivot joint 246 opens the air valve assembly 258 to allow air flow from the air passage 254 to the air passage 256. The air supply assembly 250 also includes an air valve adjustor 260 coupled to a needle 262, such that the needle 262 is movable via rotation of the air valve adjustor 260 to regulate the air flow to the twist tip assembly 200. As illustrated, the trigger 244 is coupled to both the fluid valve assembly 232 and the air valve assembly 258, such that fluid and air simultaneously flow to the twist tip assembly 200 as the trigger 244 is pulled toward a handle 264 of the body 202. Once engaged, the spray coating device 12 produces an atomized spray with a desired spray pattern and droplet distribution. Again, the illustrated spray coating device 12 is only an exemplary device of the present technique. Any suitable type or configuration of a spraying device may be used in conjunction with the twist tip assembly 200 as provided.

Figure 4:
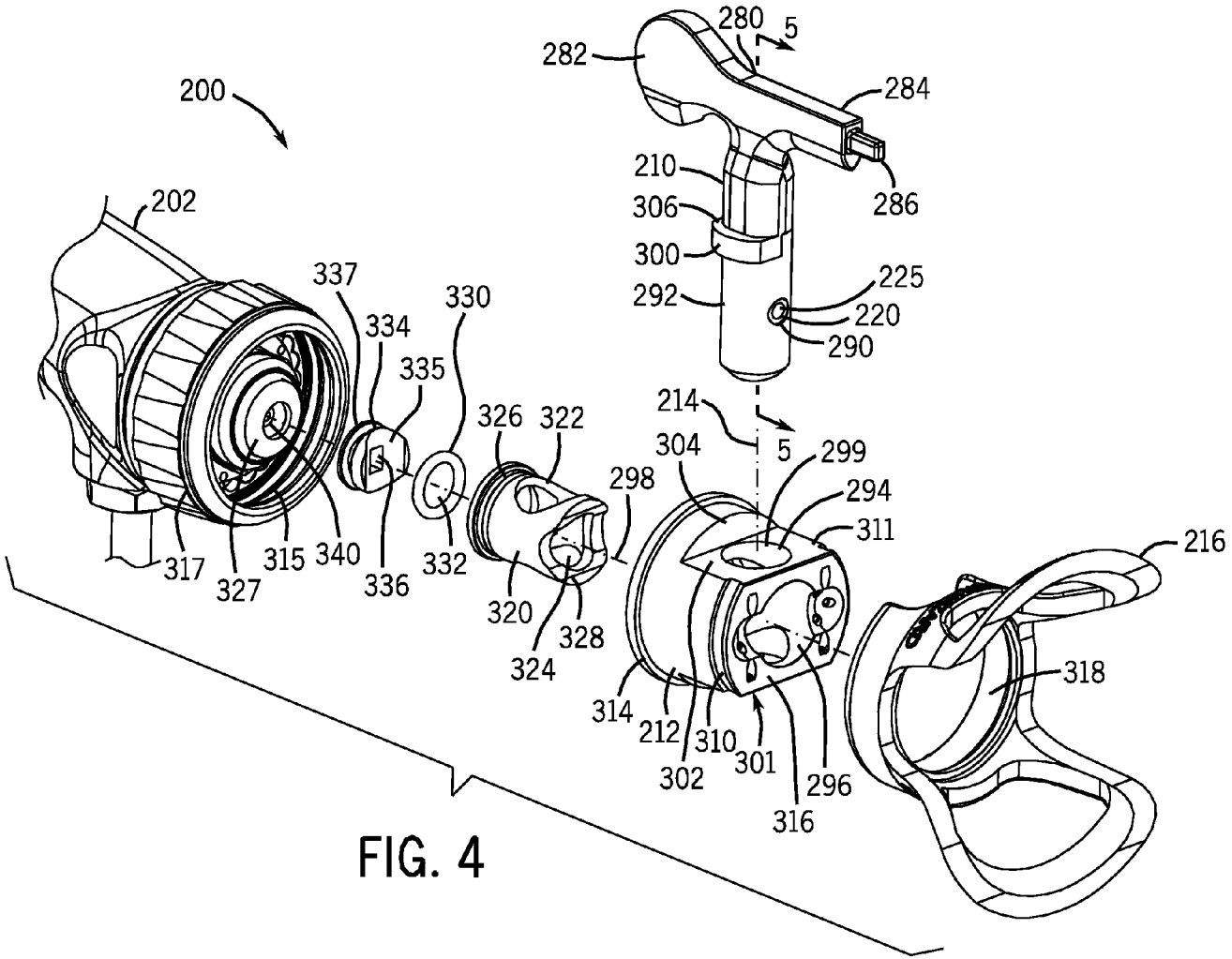
FIG. 4 is an exploded perspective side view of the spray tip assembly of FIG. 3.

FIG. 4 is an exploded view of an exemplary twist tip assembly 200 relative to a partial perspective view of the body 202. As illustrated, the twist tip 210 is shown along its axis of rotation 214 relative to the air cap 212. When the twist tip 210 is inserted into the air cap 212, the twist tip 210 is capable of rotation about the axis 214. The twist tip 210 includes a gripping portion 280 that may be used by an operator to rotate the twist tip 210 and, in particular embodiments, remove the twist tip 210 from the twist tip assembly 200 to, for example, clear obstructions in the internal passage 220. The gripping portion 280 includes a rounded end 282 (e.g., a tab or ear) and an elongated end 284 that may indicate to an operator the extent of rotation about the axis 214. That is, the gripping portion 280 is asymmetrically disposed about the axis 214 so that an operator may estimate the degree of rotation about the axis 214 by examining the position of the rounded end 282 and the elongated end 284. The elongated end 284 may also include a directional indicator 286 that extends from the gripping portion 280 in the same direction as integral bore 290, which defines part of the internal passage 220. When the twist tip 210 is rotated, the angle of directional indicator 286 provides an indication as to the position of integral bore 290 relative to the twist tip assembly 200.

The twist tip 210 also includes an extending portion 292 that is sized and shaped to be inserted into a first bore 294 in the air cap 212. When the twist tip 210 is inserted into the first bore 294 of the air cap 212, the integral bore 290 may be aligned with a second bore 296 by rotating the twist tip 210. In this manner, the integral bore 290 may be aligned along the axis 298 of the internal passage 220. As illustrated, the first bore 294 and the second bore 296 are substantially orthogonal to one another. Further, rotation of the twist tip 210 may also change the angle and alignment of the internal bore 290, which may cause the ejection port 225 to be rotated off-axis from axis 298. In this manner, an operator may change the angle and/or direction of flow out of the spray device 12. Although the twist tip 210 is shown as being inserted into a top 299 of the integral bore 294 (e.g., in FIG. 3) corresponding to the top of the air cap 212, it should be understood that the twist tip 210 may be inserted into a bottom 301 of the integral bore 294. That is, the proportions of the twist tip 210 and the integral bore 294 are such that the integral bore 290 is aligned along the axis 298 when inserted from the top 299 or bottom 301 of the integral bore 294.

The twist tip 210 also includes a protrusion 300 that is sized and shaped to interact with a top surface 302 of the air cap 212 to prevent any further downward insertion of the twist tip into the first bore 294 than is needed to align the integral bore 290 with the axis 298. The protrusion 300 is positioned along the extending portion 292 to facilitate this alignment. In addition, the protrusion 300, through interaction with rear surface 304, may define the degree of rotation for the twist tip 210. Further rotation of the twist tip 210 is prevented at the point at which the abutment surface 306 of the protrusion abuts against the rear surface 304.

The air cap 212 may also include mating features for coupling to additional components of the twist tip assembly 200. Further, the air cap 212 is a separate removable part from the twist tip 210 and may be removed from other components of the twist tip assembly 200. As illustrated, the air cap 212 may include a groove or channel 310 that is configured to mate with a complementary feature on the finger guard 216. The finger guard 216 has a cylindrical bore 318 that accommodates a cylindrical portion 311 of the air cap 212. In addition, the air cap 212 may include one or more threads (e.g., female or male threads) 314 or other mating features sized and shaped to mate with a complementary threads 315 (e.g., male or female threads) on a retaining nut 317. It should be understood that complementary mating features may include threads (e.g., male and female), notches and recesses, ridges and grooves, or other features to facilitate coupling of the twist tip assembly 200. The air cap 212 also includes an exterior surface 316 with spray shaping features as discussed in detail below.

The twist tip assembly 200 may also include a core portion 320 that is configured to fit inside of the air cap 212. The core portion 320 includes a first bore 322 and a second bore 324 that are sized and shaped to align with the first bore 294 and the second bore 296 of the air cap 212 to define the internal passage 222 when the core portion 320 is inserted into the passageway defined by the second bore 296. The core portion 320 may also include mating features 326 that may mate with complementary features on a mounting component 327 and/or the air cap 212. In addition, the core portion 320 may include a front surface 328. The front surface 328, when inserted into the air cap 212, aligns with the exterior face 316 of the air cap 212. As such, the front surface 328 may be shaped or otherwise formed to incorporate the spray shaping features of the exterior face 316.

The core portion 320 may be coupled to the mounting component 327 by a brace piece 334 and a washer 330. The brace piece 334 includes a shaped surface 335 and one or more mating components 337 for coupling the brace piece 334 and washer 330 to the mounting component 327. To that end, portions of the brace piece 334, such as surface 335, may be shaped or curved to facilitate the coupling. Both the brace piece 334 and the washer 330 include respective bores 336 and 332 along the axis 298 that further define the internal passage 220. Generally, the internal passage is aligned along the axis 298. However, a portion of the passage 220 defined by the bore 290 may be rotated off-axis from the axis 298 via rotation of the twist tip 210. In addition, bores 322 and 294 align along axis 214 to form a receptacle for insertion of the twist tip 210. As such, when the retaining nut 317, the mounting component 327, the brace piece 334, the washer 330, the core portion 320, the air cap 212, the twist tip 210, and the finger guard 216 are assembled, bores 340, 336, 332, 324, 296, 290, and 318 all align to form the internal passage 220.

Figure 5:
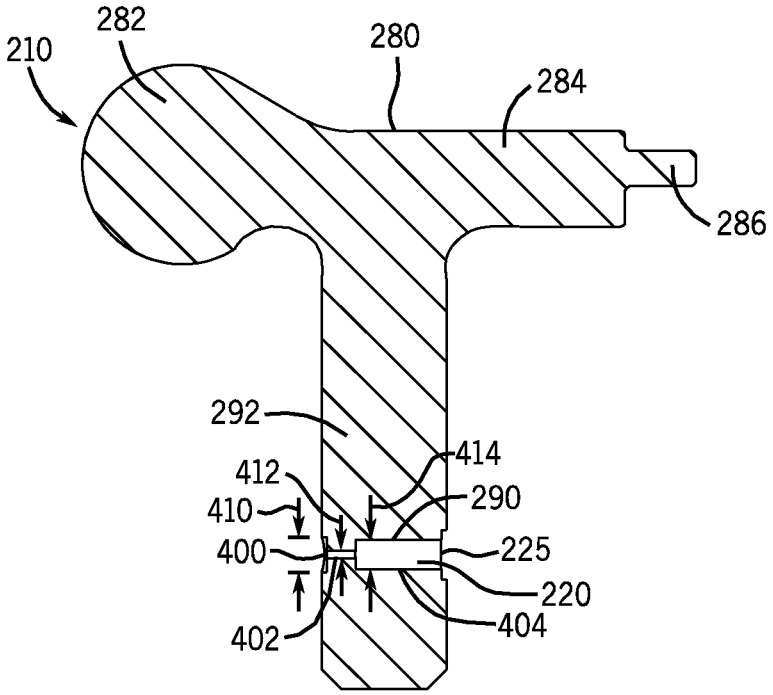
FIG. 5 is a cross-sectional view through line 5-5 of the twist tip of FIG. 6.

As noted, the internal passage 220 includes a portion defined by the bore 290. FIG. 5 is a cross-sectional view of the twist tip 210 that illustrates an embodiment in which the bore 290 includes sections of varying sizes. The particular configuration of the internal bore 290 may facilitate mixing and/or atomization of the fluid in the internal passage 220 prior to the fluid exiting the spray device 12. As illustrated, the twist tip 210 may include an upstream opening 400 that is sized and shaped to align the internal bore 290 with the rest of the internal passage 220. The upstream opening 400 is oversized relative to its adjoining passages. As such, rotation of the twist tip 210 within a portion of its range of rotation still allows the upstream opening 400 to, at least partially, align with its adjoining passages, e.g., passages formed by bores 340, 336, 332, 324, and 296. Downstream of the upstream opening 400, the bore 290 includes an orifice portion 402 that is smaller in diameter than both of its adjacent bore portions. Downstream of the orifice portion 402 is an expansion chamber 404 that opens into ejection port 225. Accordingly, fluid passing through orifice portion 402 is allowed to expand into expansion chamber 404, which may facilitate atomization of the spray. The relative diameters 410, 412, and 414 of the upstream opening 400, the orifice portion 402, and the expansion chamber 404, respectively, along the axis 214 define the particular qualities of the fluid atomization. In one embodiment, upstream opening 400 and expansion chamber 404 have relatively equal diameters 410 and 414. In addition, the diameter of the orifice portion 402 may be less than approximately 50% of the diameter 414 of the expansion chamber 404.

Figure 6:
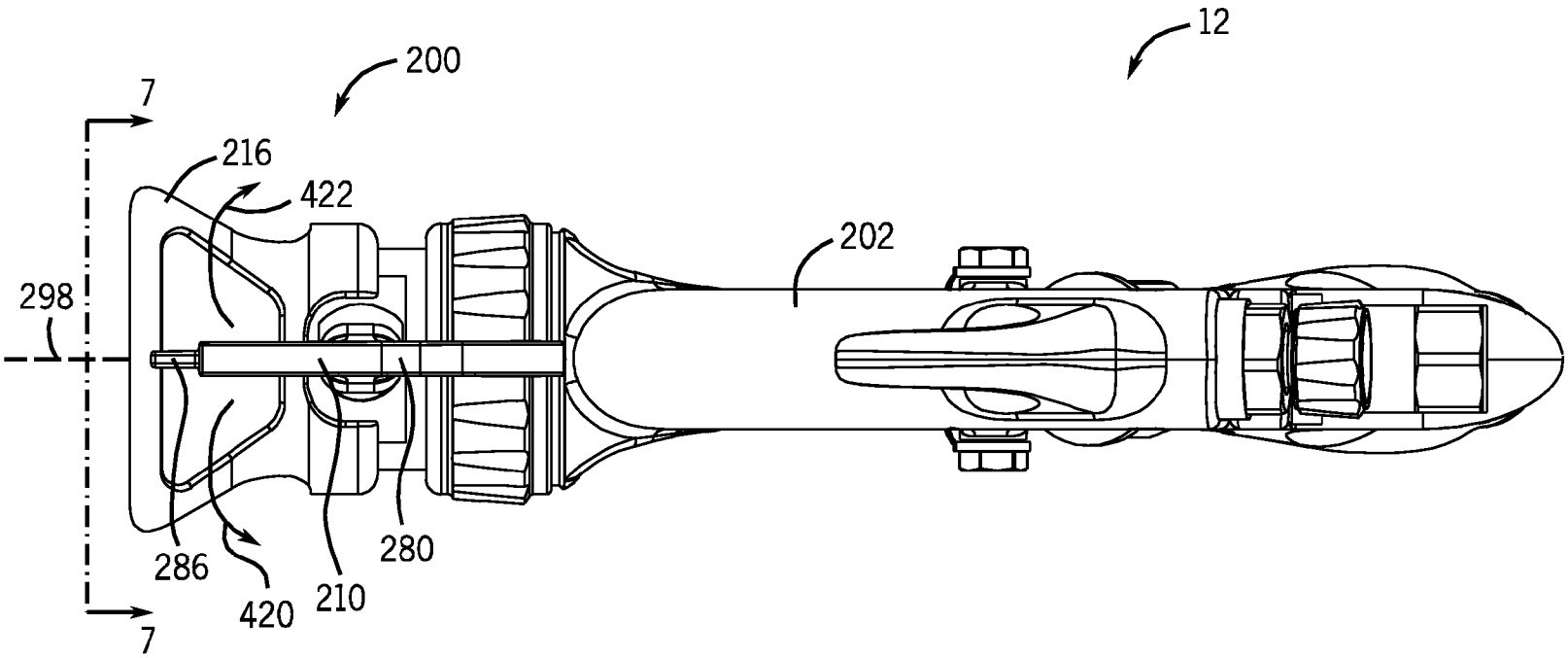
FIG. 6 is a top view of the spray coating device of FIG. 3.

FIG. 6 is a top view of the spray device 12 with a twist tip assembly 200. As noted, the twist tip portion 210 of the twist tip assembly 200 may be rotated about axis 214 (see FIG. 4) via gripping portion 280. The twist tip 210 may be rotated in the direction of arrows 420 or 422 to adjust the alignment of internal passage 220 and to rotate the twist tip 210 relative to the other components of the twist tip assembly 200, e.g., the retaining nut 317 and the finger guard 216, and relative to the body 202. Rotation of the twist tip 210 may result in the directional indicator 286 being moved off of (e.g., out of alignment with) axis 298, providing visual indication of the extent of the rotation of the twist tip 210.

Figure 9:
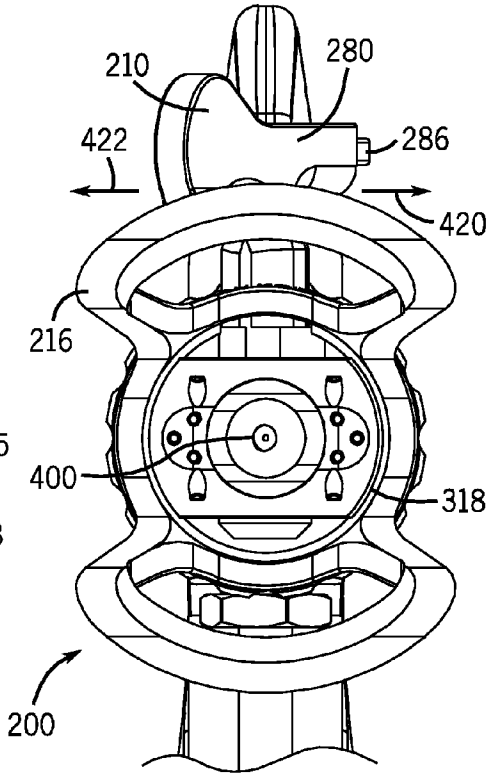
FIG. 9 is a front view of the spray tip assembly illustrating an embodiment in which the twist tip is rotated about its axis so that the spray exit is off-center towards the left.
Figure 8:
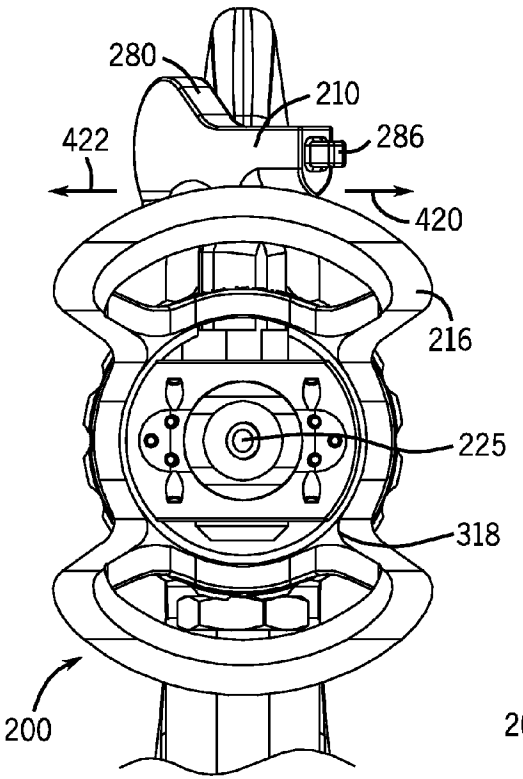
FIG. 8 is a front view of the spray tip assembly illustrating an embodiment in which the twist tip is rotated about its axis so that the spray exit is off-center towards the right.
Figure 7:
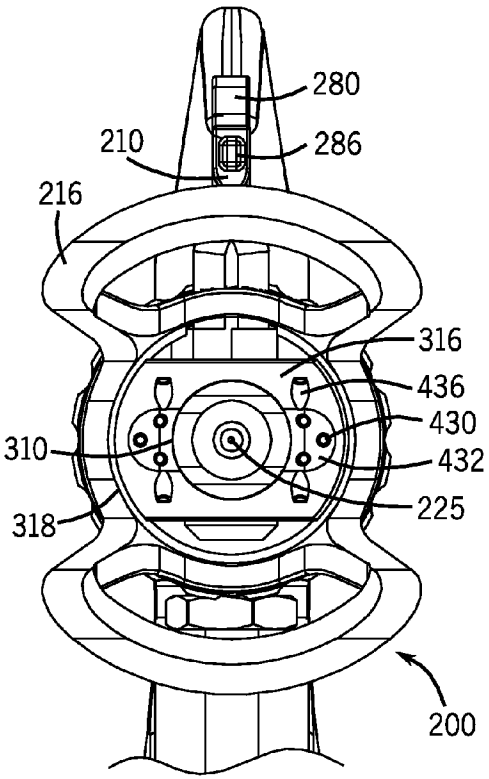
FIG. 7 is a front view along line 7-7 of an embodiment of spray tip assembly that may be used in conjunction with the spray device of FIG. 6.

As illustrated in FIGS. 7-9, rotation of the twist tip 210 relative to the body 202 changes the direction of the ejection port 225, which represents the downstream-most portion of the internal passage 220 (see FIG. 3). By rotating the twist tip 210, an operator may change the direction of the spray exiting the ejection port 225. In addition, rotation of the twist tip 210 changes the relationship between adjacent portions of the internal passage 220. By changing the alignment, the amount of fluid exiting the device 12 may be altered. Turning to FIG. 7, which is a front view of the twist tip assembly 200 along line 7-7 of FIG. 6, the illustrated embodiment shows the twist tip gripping portion 280 and directional indicator 286 aligned such that the ejection port 225 is generally centered within bore 318 of the finger guard 216. In FIG. 8, rotation of the twist tip 210 in the direction of arrow 420 results in the ejection port 225 being moved away from the center of bore 318 in finger guard 216. FIG. 9 illustrates further rotation of the twist tip 210, which may result in additional changes in orientation of the ejection port 225 relative to the internal passage 220. For example, the rotation in the direction of the arrow 420 may result in the upstream opening 400 being moved within bore 318. In such an embodiment, the spray may be prevented from exiting the device 12 because the internal passage 220 is interrupted by the twist tip alignment. In other embodiments, the twist tip 210 may be rotated in the direction of arrow 422. As such, an operator may adjust the direction or flow via rotation of the twist tip 210. For example, slight rotation of the twist tip 210 in the direction of arrow 420 or 422 may reduce the flow through the ejection port 225 by altering the alignment of opening 400 with the upstream portions of the integral passage 220. Further, rotation of the twist tip 210 may halt the fluid flow, allowing an operator to turn off the flow via 90° rotation of the twist tip. In other embodiments, rotation of the twist tip 210 may also the operator to unclog the twist tip 210. That is, the rotation from a first spray mode (e.g., around a 0° point, or where the directional indicator 286 is aligned with the direction of fluid flow, as shown in FIG. 7) to a second spray mode (e.g., at about a 180° point along the circumference of rotation) may result in mechanical unclogging of the twist tip fluid flow path via scraping or friction as the twist tip 210 rotates within the bore 294. Additional spray control may be provided via fan shaping features, which is provided by the adjustable air valve 260 and needle 262.

In addition, the twist tip assembly 200 may include surface features for shaping a spray. As illustrated in FIG. 7, an exterior surface 316 of the air cap 212 includes a plurality of openings 430 for channeling air outwards from the exterior surface and towards the fluid spray. The openings 430 may be disposed within a recess 432 formed in the exterior surface 316. As illustrated, the recess 432 may have a substantially racetrack shape or may have a generally circular or oval shape. In addition, the openings 430 may be disposed on a flat or floor portion of the recess 432 or on a banked or angled portion of the recess 432. In particular, the openings 430 may be angled towards the fluid flow path. In addition, the exterior surface 316 may include one or more channels or grooves 436 that intersect the recess 432. Such surface features (e.g., the recess 432 and grooves 436) help direct the air flow towards the spray to provide a desired spray shape by directing air pressure at the edges of the spray. In particular embodiments, the openings 430, recess 432, and grooves 436 are disposed symmetrically about the bore 318.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A spray system, comprising:

a fluid spray tip assembly, comprising:

an air cap having a first bore along an axis of fluid flow and a second bore substantially orthogonal to the first bore;

a twist tip configured to be partially inserted into the second bore, wherein the twist tip comprises an internal bore configured to be coaxially aligned with the first bore;

a core structure configured to be inserted into the first bore, wherein the core structure comprises a third bore configured to be coaxially aligned with the first bore and a fourth bore substantially orthogonal to the third bore, and the third bore is configured to accommodate and surround an internal bore opening of the twist tip, and wherein, when the twist tip is inserted, the third bore comprises a terminal opening abutting the twist tip, the terminal opening comprising a core exterior face that co-terminates with an air cap exterior surface such that the core exterior face and the air cap exterior surface form a portion of an assembly exterior surface of the twist tip assembly, and wherein the core exterior face is surrounded by the air cap.

2. The system of claim 1, wherein the exterior face forms a front surface of the core structure that is shaped to align with a front surface of the air cap.

3. The system of claim 1, comprising a retaining nut configured to mount the air cap and the twist tip to a spray coating device.

4. The system of claim 1, comprising a finger guard coupled to the air cap, wherein the finger guard comprises a cylindrical bore configured to surround at least a portion of the air cap and the core structure.

5. The system of claim 4, wherein the air cap comprises an outer groove configured to mate with a complementary feature on the finger guard to secure the finger guard to the air cap.

6. The system of claim 1, wherein the internal bore comprises a passage adjacent to the internal bore opening, wherein the internal bore opening comprises a first diameter that is larger than a second diameter of the passage.

7. The system of claim 1, wherein the internal bore comprises an orifice downstream of the internal bore opening, wherein the internal bore opening has a first diameter that is larger than a third diameter of the orifice.

8. The system of claim 7, wherein the internal bore comprises an expansion chamber, wherein a fourth diameter of the expansion chamber is larger than the third diameter of the orifice.

9. The system of claim 1, wherein the air cap comprises an exterior shoulder adjacent to the second bore, wherein the exterior shoulder is configured to abut a protrusion of the twist tip.

10. The system of claim 9, wherein the exterior shoulder defines a degree of rotation of the twist tip within the second bore.

11. The system of claim 9, wherein the protrusion is disposed proximal to an extending portion of the twist tip, and wherein the extending portion is configured to be inserted into the second bore.

12. The system of claim 11, wherein the second bore is sized and shaped to fit only the extending portion.

13. The system of claim 11, wherein the internal bore is disposed on an extending portion of the twist tip and is fluidly coupled to the internal bore opening.

14. The system of claim 1, wherein the twist tip comprises an indicator configured to indicate a position of the internal bore relative to the twist tip assembly.

* * * * *